US006332773B1

(12) United States Patent
Kuhn

(10) Patent No.: US 6,332,773 B1
(45) Date of Patent: Dec. 25, 2001

(54) HANDLE FOR GAS BURNERS

(75) Inventor: Hans-Peter Kuhn, Nalbach (DE)

(73) Assignee: J. Lorch Gesellschaft & Co. GmbH, Waldenbuch (DE)

( * ) Notice: Subject to any disclaimer, the term of this patent is extended or adjusted under 35 U.S.C. 154(b) by 0 days.

(21) Appl. No.: 09/381,921

(22) PCT Filed: Sep. 18, 1998

(86) PCT No.: PCT/EP98/05961

§ 371 Date: Sep. 27, 1999

§ 102(e) Date: Sep. 27, 1999

(87) PCT Pub. No.: WO99/19671

PCT Pub. Date: Apr. 22, 1999

(30) Foreign Application Priority Data

Oct. 15, 1997 (DE) ..... 197 45 487

(51) Int. Cl.[7] ..... F23D 14/46; B23K 7/10; B23K 9/28

(52) U.S. Cl. ..... 431/345; 431/154; 431/354; 239/526; 239/600; 285/317; 285/308

(58) Field of Search ..... 431/142, 354, 431/345, 154, 326; 285/319, 313, 308, 318, 921; 239/DIG. 2, 526, 525, 600, 530; 126/414, 229, 231, 232, 233, 234, 235, 92 B

(56) References Cited

U.S. PATENT DOCUMENTS

| | | | | |
|---|---|---|---|---|
| 2,021,241 | * | 11/1935 | Mall . | |
| 2,648,378 | * | 8/1953 | Jenkins | 431/355 |
| 2,771,308 | * | 11/1956 | Vitcha et al. . | |
| 3,425,406 | * | 2/1969 | Mejyr | 126/92 B |
| 3,783,233 | | 1/1974 | Dal Molin . | |
| 4,013,395 | | 3/1977 | Wormser . | |
| 4,128,391 | * | 12/1978 | Braunstein | 431/354 |
| 4,753,268 | * | 6/1988 | Palau | 285/137.1 |
| 4,928,859 | * | 5/1990 | Krahn et al. | 285/317 |
| 5,370,527 | * | 12/1994 | Hefling et al. | 431/344 |
| 5,683,117 | * | 11/1997 | Corbett et al. | 285/305 |
| 5,941,577 | * | 8/1999 | Musellec | 285/317 |

FOREIGN PATENT DOCUMENTS

| | | |
|---|---|---|
| 944 541 | 6/1956 | (DE) . |
| 39 27 091 | 11/1990 | (DE) . |
| 0 512 942 | 11/1992 | (EP) . |

* cited by examiner

*Primary Examiner*—Carl D. Price
(74) *Attorney, Agent, or Firm*—Paul Vincent

(57) ABSTRACT

A handle (1) for gas burners, wherein a plug insert is locked in an axial direction by means of a lock (10) and rotation of the plug insert is fixed at a particular position. When the lock (10) is activated, the rotational locking can be released so as to modify the rotational position of the plug insert, without having to remove the plug insert from the handle.

12 Claims, 3 Drawing Sheets

HANDLE FOR GAS BURNERS

BACKGROUND OF THE INVENTION

The invention concerns a handle for gas burners having a plug insert with a peripheral groove into which a handle lock snaps, with the plug insert having at least one associated a peripheral receptacle in the vicinity of its peripheral groove.

Handles for gas burners are known in the art. The supply hose for introduction of the gas is normally connected to these handles and the handle can be equipped with differing plug inserts. The differing plug inserts are adapted to the respective operating requirements. In this manner, the handle can be equipped with long or short plug inserts having round nozzles, flat nozzles or the like. These plug inserts have a peripheral groove at that end which is to be plugged into the handle into which a locking mechanism latches which is provided in the receiving opening for the plug insert. The plug insert is then securely connected to the handle and fixed in an axial direction so that it cannot slip out of the handle. Rotation of the plug insert in the handle is prevented by providing the plug insert, at its end which is to be plugged in, with an outer toothing extending in the peripheral direction which engages into a corresponding inner toothing in the handle when this end of the plug insert is plugged into the handle. Should the user want to rotate the plug insert in the handle, he must operate the locking mechanism to disengage the plug insert, remove it from the handle, rotate it and subsequently plug it back in at the desired rotated position. This is cumbersome and the user could be injured if the plug insert is hot.

It is therefore the underlying purpose of the invention to design a handle of the above mentioned kind in such a fashion that the plug insert can be more easily rotated relative to the handle.

SUMMARY OF THE INVENTION

This purpose is achieved in accordance with the invention in a handle for gas burners of the above mentioned kind in that a catch element is disposed on the handle which can be brought into a release position and which engages into the peripheral receptacle.

The catch element, engaging in its neutral position into the peripheral receptacle to prevent a rotation of the plug insert, permits rotation thereof in a simple fashion by disengaging the catch element from the peripheral receptacle when the plug insert is latched in. The catch element is thereby brought from a neutral position into a release position.

An improvement of the invention provides that the lock is coupled to a catch element which engages into the peripheral receptacle of the plug insert.

Connection of the catch element, preventing a rotation of the plug insert in the handle, to the lock permits disengagement of the catch element from the plug insert through operation of the lock to allow rotation thereof in the handle in the plugged-in state. If, for example, another rotational position for the plug insert relative to the handle is desired, it is no longer necessary to completely remove the plug insert from the handle in order to release the rotational catch. One must only operate the lock to thereby operate the catch element and to disengage same from the peripheral receptacle. In this manner, the plug insert can be easily and rapidly rotated into the desired position. In addition, the danger of injury is substantially reduced, since the plug insert must no longer be pulled out of the handle.

An improvement provides that the receptacle is one or a plurality of holes preferentially distributed about the periphery of the plug insert. A catch element, configured as a pin engages into these holes. In this manner, the plug insert can be locked in predetermined rotational positions at which the catch element engages into the holes. As already mentioned, the catch is released by lifting the catch element out of these holes though operation of the lock.

In another embodiment, the receptacle is an outwardly toothed ring. A catch element having corresponding teeth directed in a radially inward fashion, engages into this outwardly toothed ring. Towards this end, the catch element only has a sufficient number of teeth to allow it to be easily removed from the outwardly toothed ring to allow the outwardly toothed ring to be rotated relative to the catch element.

The lock and the catch element are preferentially operable via a common release button. This allows for a reduction in the number of operational elements in the handle and simplifies operation of the handle. In addition, the release button can be disposed at an ergonomically preferred location.

An embodiment provides that the lock protrudes radially beyond the catch element in an inward direction. If the release button is then only lightly pressed, the catch element disengages from the peripheral receptacle but the lock still remains engaged in the peripheral groove. The plug insert therefore remains locked into the handle, but can be rotated.

The release button preferentially has two operating positions. These operating positions can be preferentially felt during operation of the release button which e.g. can be effected through appropriate latching means.

The peripheral receptacle is preferentially provided on the pipe of the plug insert. In this manner, a direct locking of the pipe can be achieved i.e. the retention force acts directly on the pipe. Particularly for the case of bent pipes, the bend angle or curvature of the pipe is adapted to the configuration of the peripheral receptacle. In this manner the plug insert can be connected to the handle in a preferred location. It is however also conceivable to dispose the peripheral receptacle at a plug connector which is screwed or pressed into the tube.

The catch element is preferentially disposed axially next to the lock. As seen in an axial direction, the peripheral receptacle can thereby also be provided next to the peripheral groove. It is however also conceivable that the peripheral groove itself be provided with the peripheral receptacle.

In a preferred embodiment, the catch element is connected to a locking element comprising the lock and is preferably latched therein. The catch element is thereby made from a metal finger. The locking element can, in addition, comprise the release button.

Further advantages, features and details of the invention can be derived from the dependent claims and the subsequent description in which a particularly preferred embodiment is described in detail with reference to the drawing. The features thereby shown in the drawing and described in the associated text and in the claims can be important to the invention individually or collectively in arbitrary combination.

DESCRIPTION OF THE PREFERRED EMBODIMENT

Figure 1:
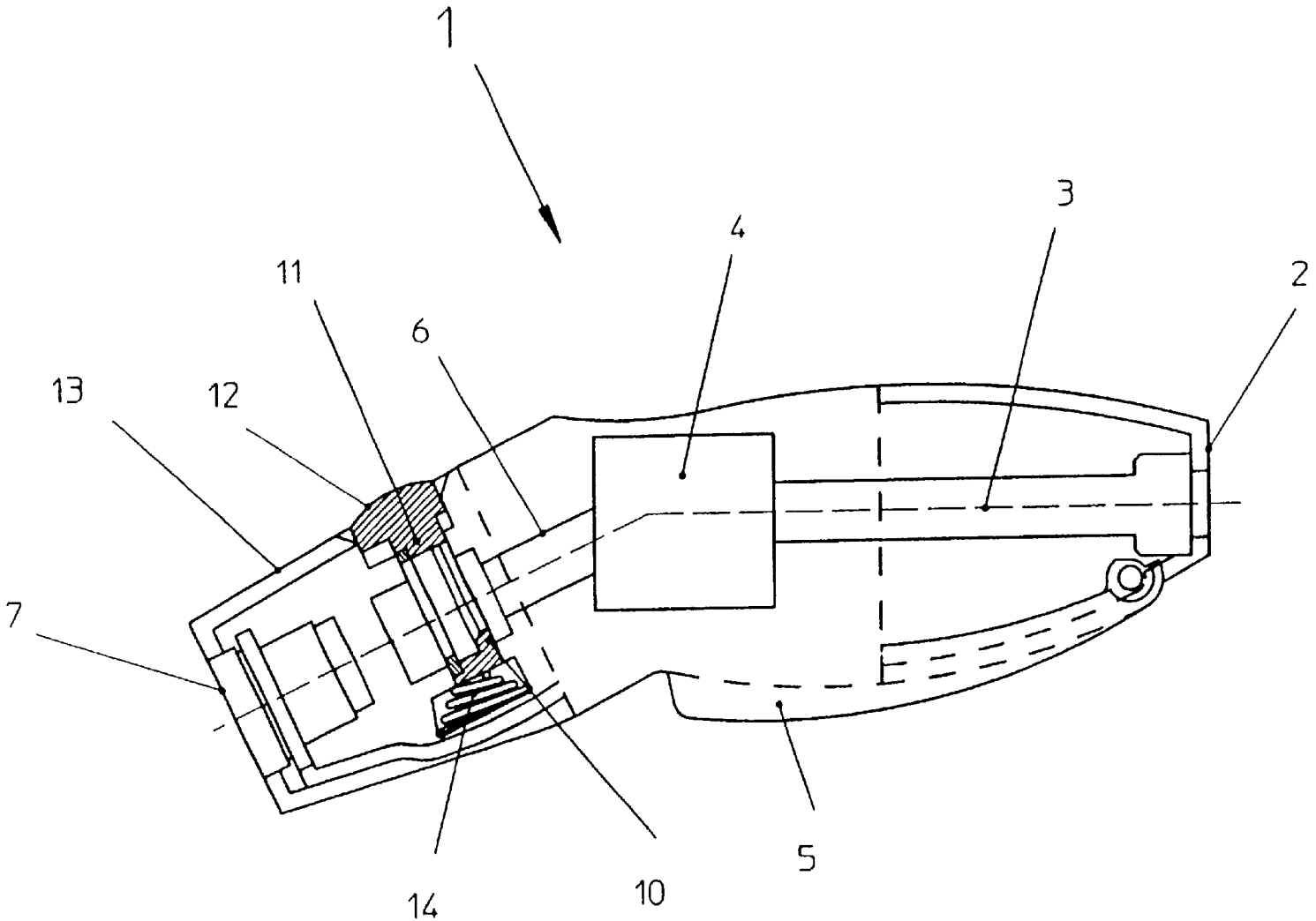
FIG. 1 shows a longitudinal section through a gas burner handle.
Figure 2:
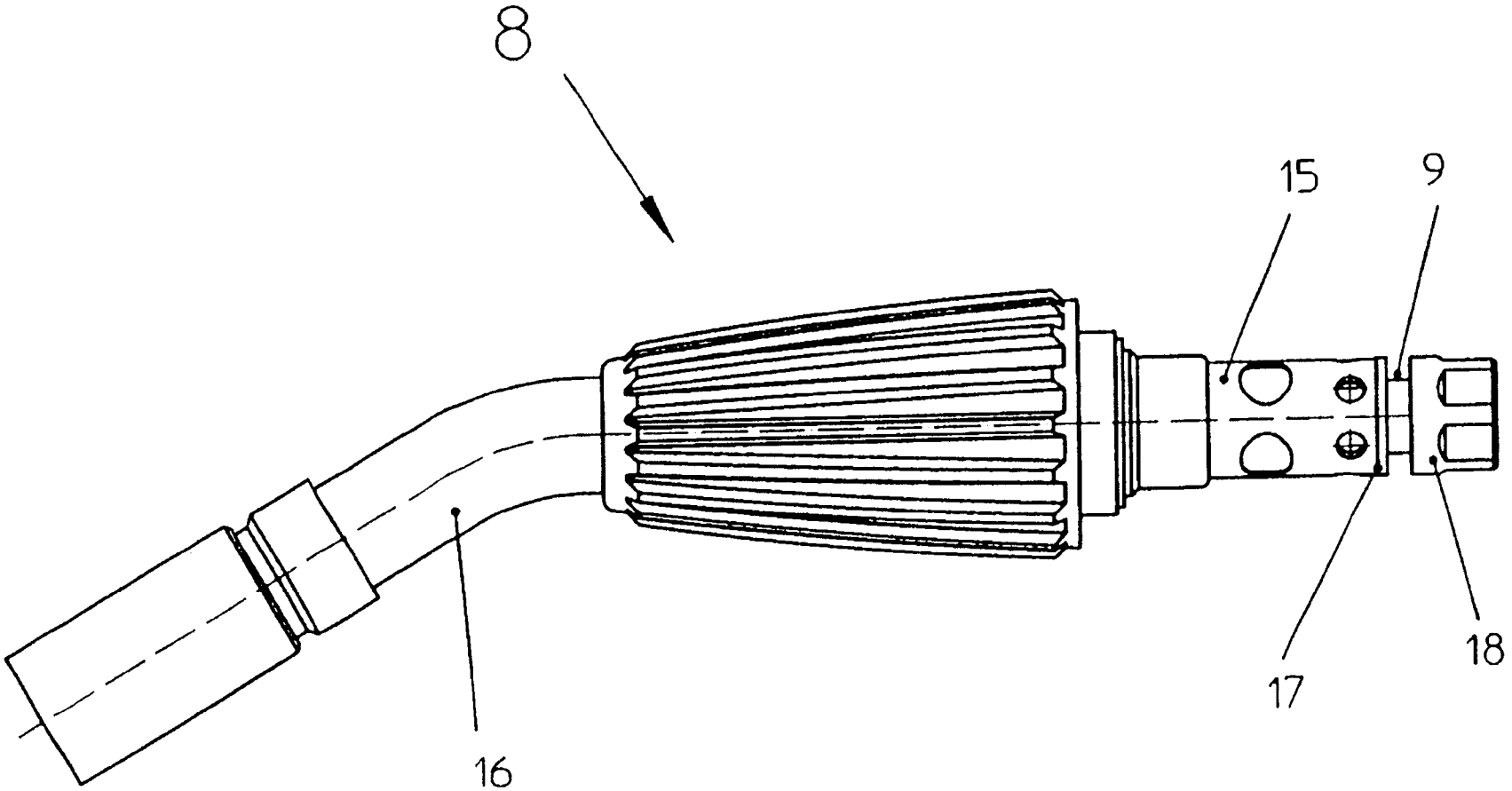
FIG. 2 shows a longitudinal section through a plug insert.

FIG. 1 shows a handle in longitudinal section designated in its entirety with 1. A connector for a gas hose (not shown) is located at one end 2 for supplying the handle 1 with gas. This gas is fed to a unit 4 via a gas conduit 3. This unit 4 has a shut-off valve (not shown), a starter as well as a lever valve which can be operated by means of an actuator 5. An additional gas conduit 6 is connected to the unit 4 which feeds out of the handle 1 at the other end 7. A plug insert 8, as shown in FIG. 2, can be inserted into this end 7. A peripheral groove 9 thereby snaps into a lock 10 having a lock element 11. The plug insert 8 is thereby directly connected to the handle 1. This lock element 11 comprises a release button 12 which projects beyond the upper side 13 of the handle 1 so that it can be operated and pushed in. In FIG. 1, the lock element 11 is shown in a neutral position in which it is held by a compression spring 14. Operating the release button 12 in a direction towards the compression spring 14 displaces the lock element 11 into a release position. The lock 10 is thereby disengaged from the peripheral groove 9 so that the plug insert 8 can be pulled out of the end 7 of the handle 1.

The plug insert 8 has a pipe 15 which, in the embodiment of FIG. 2, comprises an angled burner end 16. A plug connector 18 is pressed into or screwed into the opposite end 17, this plug connector 18 having the peripheral groove 9.

Figure 3:
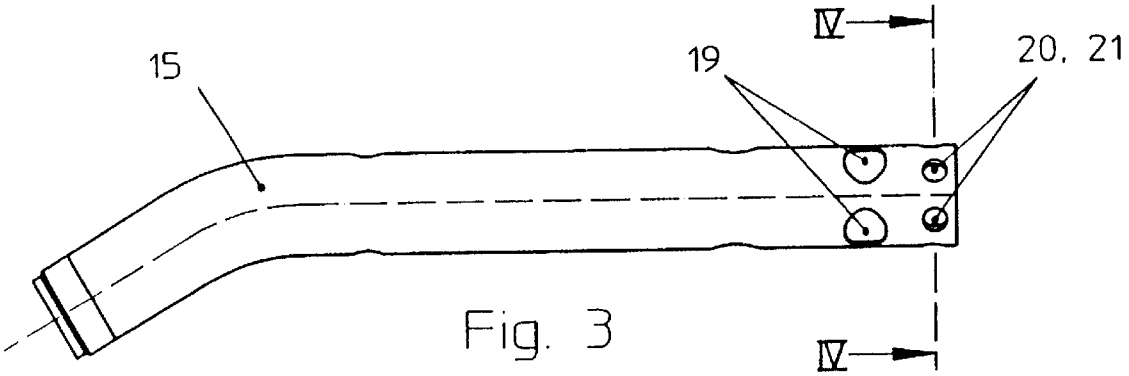
FIG. 3 shows an angled pipe of a plug insert.

The pipe 15 is shown in FIG. 3, wherein air openings 19 as well as peripheral receptacles 20 can be easily seen. The peripheral receptacles 20 are likewise configured as holes 21.

Figure 4:
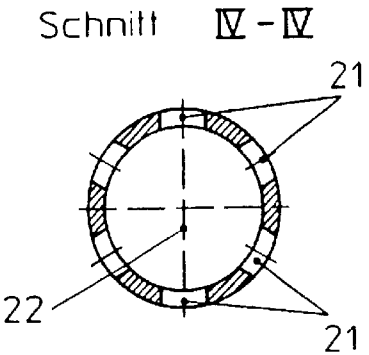
FIG. 4 shows a section IV—IV through the pipe in accordance with FIG. 3.

FIG. 4 shows a cross-section IV—IV, wherein a total of six holes 21 can be seen to be evenly distributed about the periphery. In addition, the angled portion of the pipe 15 lies in the vertical plane 22 in which two holes 21 are also located so that, as described below, a preferred position for the pipe 15 and the plug insert 8 is effected in handle 1.

Figure 6:
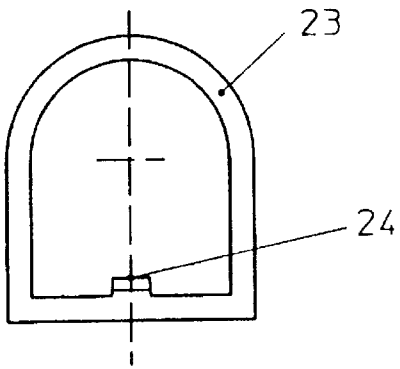
FIG. 6 shows the catch element.
Figure 5:
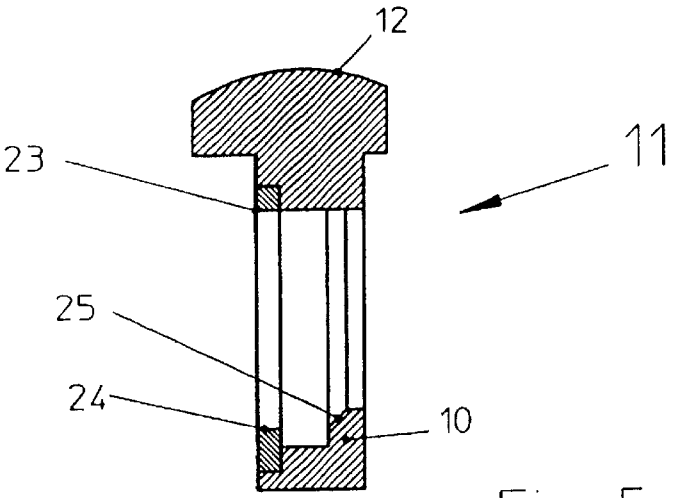
FIG. 5 shows a cross-section through the locking element.

FIG. 5 shows the lock element 11 in an enlarged representation. A catch element 23 (FIG. 6) is inserted into this lock element 11. The catch element 23 has a latching nub 24 protruding radially in an inward direction.

When the plug insert 8 is pushed into the end 7 of the handle 1, the plug connector 18 initially abuts, at a free end thereof, against a bevel 25 of the plug 10 and pushes same out of its neutral position into the release position, i.e. in opposition to the force of the compression spring 14, in a radially downward direction. The catch element 23 is also thereby displaced. The plug connector 8 can only be pushed so far into the handle 1 until the lock 10 snaps into the peripheral groove 9 to lock the plug connector 18, and thereby the plug insert 8, in the handle 1. The latching nub 24 thereby comes to rest in the plane IV—IV (FIG. 3). The plug insert 8 is locked in the handle 1 but can be rotated until the latching nub 24 snaps into a peripheral receptacle 20 or into a hole 21 in response to the force of the compression spring 14. The plug insert 8 thereby assumes a fixed rotational position relative to the handle 1.

By moving the release button 12 into an intermediate position, the latching nub 24 of the catch element 23 can be lifted out of the hole 21, wherein the lock 10 no longer engages within the peripheral groove 9 along its entire radial extent rather only along a portion thereof so that the plug insert 8 is still locked in the handle 1 to prevent it from being pulled out thereof, but can be rotated.

In order to pull the plug insert 8 out of the handle 1, the release button 12 is pushed in to a further extent and the lock 10 is thereby moved out of the peripheral groove 9. The plug insert 8 is then disengaged. Plug inserts 8 can however also be envisioned which have a smooth peripheral surface instead of peripheral receptacles 20. This type of plug insert 8 can likewise be locked in the handle 1. They are however not fixed with respect to rotation and, in the locked state, can therefore be brought into the desired rotational position at any time.

What is claimed is:

1. A handle for a gas burner, the handle comprising:

a housing defining a first conduit for transporting gas from a first conduit input to a first conduit output;

a plug insert defining a second conduit, said second conduit hating an input proximate to and in fluid communication with said first conduit output to transport the gas through said second conduit to a second conduit output, said plug insert having a peripheral groove at a first axial location and a recepticle means at a second axial location spaced apart from said first axial location; and a lock mechanism inserted into said housing, said lock mechanism having a locking protrusion seating in said peripheral groove and a latching nub axially spaced apart from said locking protrusion for seating in said receptacle means, said locking protrusion having a radial extension differing from a radial extension of said latching nub, wherein said locking protrusion and said latching nub disengage said peripheral groove and said receptacle means when said lock mechanism is pushed in an inward direction.

2. The handle of claim 1, wherein said latching nub is coupled to said locking protrusion.

3. The handle of claim 1 wherein said receptacle means has at least one hole.

4. The handle of claim 1, wherein said receptacle means has a plurality of holes distributed about a periphery of said plug insert.

5. The handle of claim 2 further comprising a release button for common operation of said locking protrusion and said latching nub.

6. The handle of claim 1, wherein said locking protrusion extends radially inwardly beyond said latching nub.

7. The handle of claim 5, wherein said release button has two operating positions.

8. The handle of claim 1, wherein said plug insert comprises a pipe on which said receptacle means is disposed.

9. The handle of claim 8, wherein said pipe and said peripheral receptacle are matched to each other in a peripheral direction.

10. The handle of claim 1, wherein said latching nub is disposed axially adjacent to said locking protrusion.

11. The handle of claim 2, wherein said latching nub is connected to said lock mechanism.

12. The handle of claim 11, wherein said latching nub is snapped into said lock mechanism.

* * * * *